US005089946A

United States Patent [19]

Mayer et al.

[11] Patent Number: 5,089,946

[45] Date of Patent: Feb. 18, 1992

[54] UNIVERSAL LIGHT BEAM MANIPULATOR

[76] Inventors: Thomas A. Mayer, 4320-B Unveristy Dr., Huntsville, Ala. 35816; Mark W. Spivey, 4413 Grier St., Gastonia, N.C. 28054

[21] Appl. No.: 727,876

[22] Filed: Jul. 10, 1991

[51] Int. Cl.[5] ..... F21V 17/02

[52] U.S. Cl. ..... 362/284; 362/322; 362/324

[58] Field of Search ..... 362/85, 233, 282, 284, 362/301, 322, 324, 449, 286

[56] References Cited

U.S. PATENT DOCUMENTS 4,392,187 7/1983 Bornhorst ..... 362/95
4,697,227 9/1987 Callahan ..... 362/284
4,890,208 12/1989 Izenour ..... 362/284
4,931,916 6/1990 Callahan ..... 362/284

*Primary Examiner*—Ira S. Lazarus
*Assistant Examiner*—Richard R. Cole

[57] ABSTRACT

A device for manipulating any lighting fixture's light beam by means of a servo motor (82), linkage (80), a universal joint (90), and a reflecting means (76). The main plate (54) can be positioned along the rods (38) to intercept the focal point of the lighting fixture's light beam. The frame plate (36) can be interchanged with other size frame plates to allow different size lighting fixtures to use the same manipulation device. The invention can be controlled by any lighting console or computer with a accessable control signal. The unit can be controlled by either a wired or wireless signal.

1 Claim, 10 Drawing Sheets

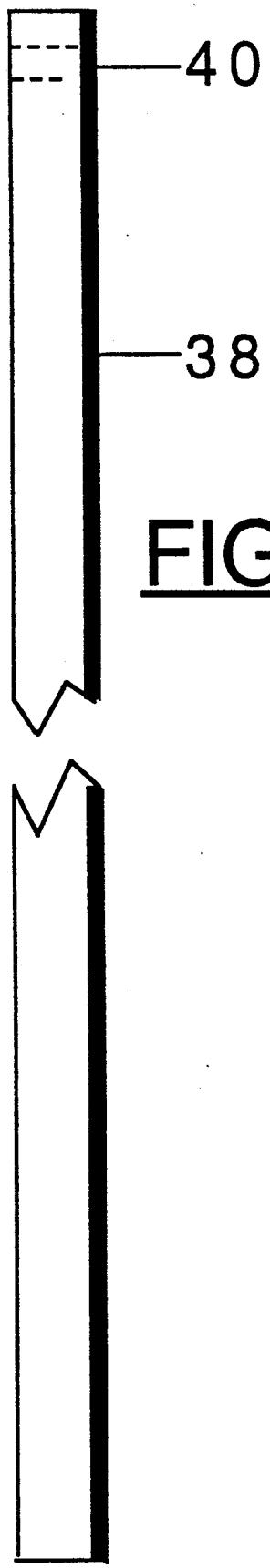
FIG. 3b
FIG. 3c
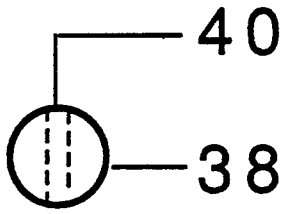

UNIVERSAL LIGHT BEAM MANIPULATOR

BACKGROUND

1. Field of Invention

This invention relates to devices used in the entertainment industry and, more specifically, to devices that can control beams of light from a source.

2. Description of Prior Art

At the present, conventional lighting systems require the lighting designer to work with lighting fixtures that emit a directional beam of light. The limitations of this type of design lie in the need to meet all aspects of design, such as visibility, motivation, revelation of form, selective visibility, and movement, with a finite number of lighting fixtures. The lighting fixtures are used in two basic fashions. Certain lighting fixtures are used to give a wash or general stage illumination. The remainder of the available lighting fixtures can then be used for highlighting special moments in the production known as specials.

The mounting positions of the lighting fixtures are generally fixed structures or trusses about the stage. The number of lighting fixtures that can be usefully mounted to any structure is limited to the amount of positioning that particular lighting fixture needs to produce the desired effect upon the stage. The reason for this is that the horizontal axis utilizes more space in positioning than does the vertical axis.

There have been several attempts to incorporate ways to manipulate the entire lighting fixture. One such attempt in known by the trade name VARILITE U.S. Pat. No. 4,392,857. This system does reduce the amount of fixtures necessary to light a production by allowing the designer to use the same lighting fixtures to perform in both wash designs as well as specials. The draw back of this system is the need to maneuver the entire fixture requires the use of powerful enough motors to move as well as smoothly stop the fixture at its desired location. Therefore, inertia of the lighting fixture places tremendous strain on the lighting fixture motors.

Some of these inertia problems have been reduced by devices that utilize a mirror to steer the light beam, as disclosed in U.S. Pat. No. 4,697,227. In this lighting fixture, the light beam is deflected through a ninety-degree angle by a mirror mounted at a 45 degree angle to the light beam. A motor rotates the mirror around the optical axis, allowing the beam to be deflected to any azimuth angle in a plane perpendicular to the optical axis. Deflectation in the elevation axis is accomplished by rotating the entire lighting fixture on an axis perpenendicular to the optical axis. Therefore, while the steering about one axis is quick and responsive, the steering on the other axis is restricted to the same inertia limitations as before.

One underling flaw in the design of these and all other automated lighting fixtures that not only adds to the cost of the units but also to the complexity of the units inner workings is the incorporation of its own lighting source in the lighting fixture itself.

Another flaw is the necessity of a specialized control unit for the specialized lighting fixtures. By developing a unit that could be operated by any lighting control board already on the market or in any installation, the time and ability to learn to manipulate the system is greatly reduced.

This invention eliminates both of the above flaws by uitlizing any existing lighting fixture on the market and the existing control console.

OBJECTS AND ADVANTAGES

The present invention is a light beam manipulating device that directs a light beam from a light source, such as a stage lighting fixture. The invention uses a mirror that is rotatable to provide control over both azmiuth and elevation axes. Since the mirror and associated drive mechanisms are of small size and weight, the positioning of the beam can be accomplished quickly and angular limitations of the drive motors are not affecting the positioning of the beam due to the lack of bodily movement of the motors with the beam.

The invention has other advantages as well:

(a) the invention is controlled by a signal that is already generated by a lighting control computer or console that is already possessed by the user of our invention;

(b) the universal frame plate allows the invention to be utilized by any lighting fixture known;

(c) the linkage assembly uses cables to manipulate the universal pivot insteed of gears. This keeps tension on the reflecting device and does not allow it's position to fluctuate;

(d) the lack of a light source enclosed in the unit allows for the elimination of a cooling fan, this makes our unit more quiet than other units available;

Briefly, and in general terms, the invention comprises of an assembly housing, a mirror means to manipulate a light beam, a drive means, and a means to attach to a lighting fixture.

DRAWING FIGURES

FIG. 1 shows a typical embodiment of the invention from a side view.

FIGS. 2*a* and 2*b* show the frame plate from a end view and a top view.

FIGS. 3*a*, 3*b* and 3*c* show lengthwise and end views of a typical rod.

Figure 6A:
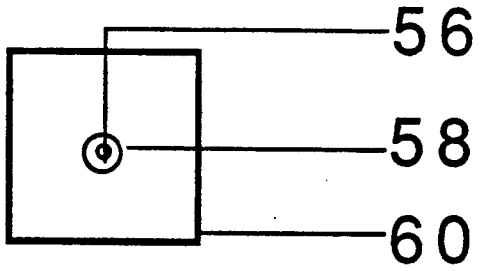
Figure 6B:
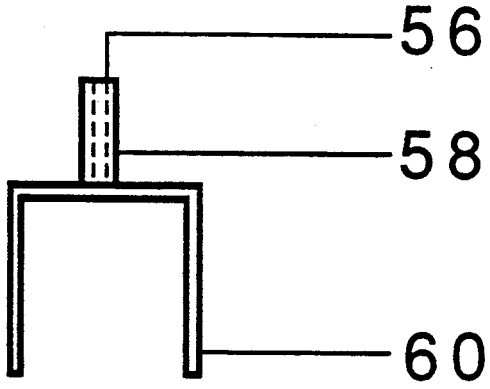
Figure 6C:
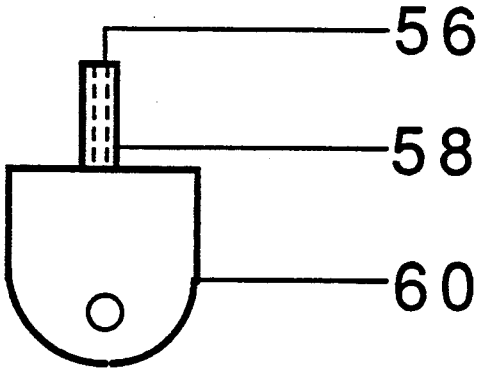

FIGS. 6*a*, 6*b* and 6*c* show top front and side views of body 1 of the universal pivot.

Figure 7A:
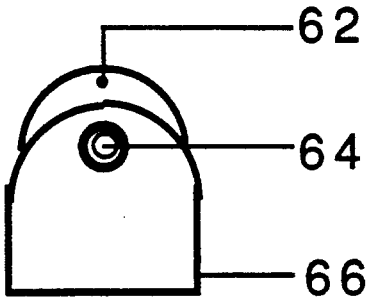
Figure 7B:
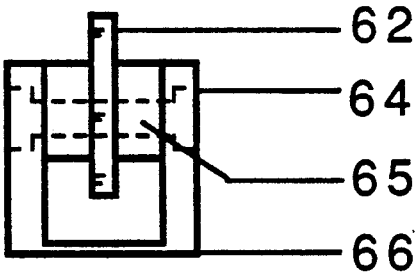
Figure 7C:
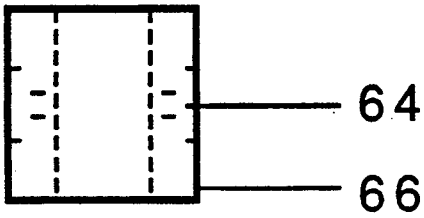

FIGS. 7*a*, 7*b* and 7*c* show side front and bottom views of body 2 of the universal pivot.

Figure 8:
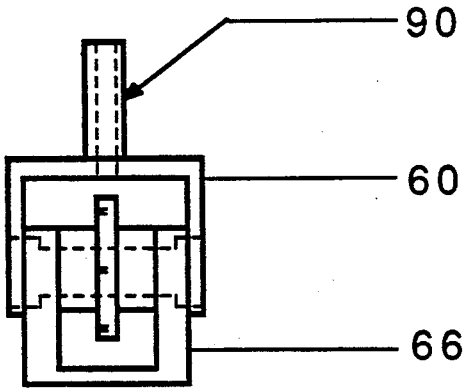

FIG. 8 shows body 1 and 2 combined to form the universal pivot.

Figure 9:
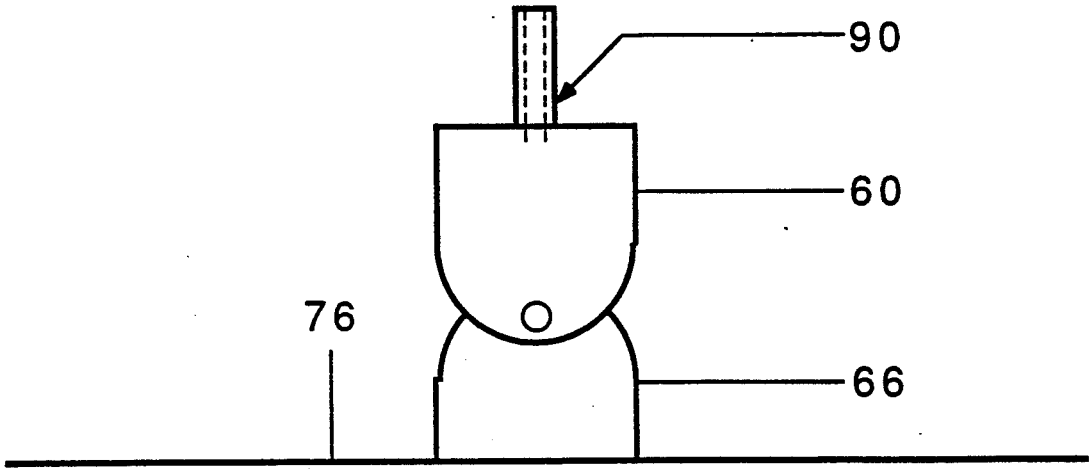

FIG. 9 shows the universal pivot with reflector attached.

DESCRIPTION—FIGS. 1 TO 9

Figure 1:
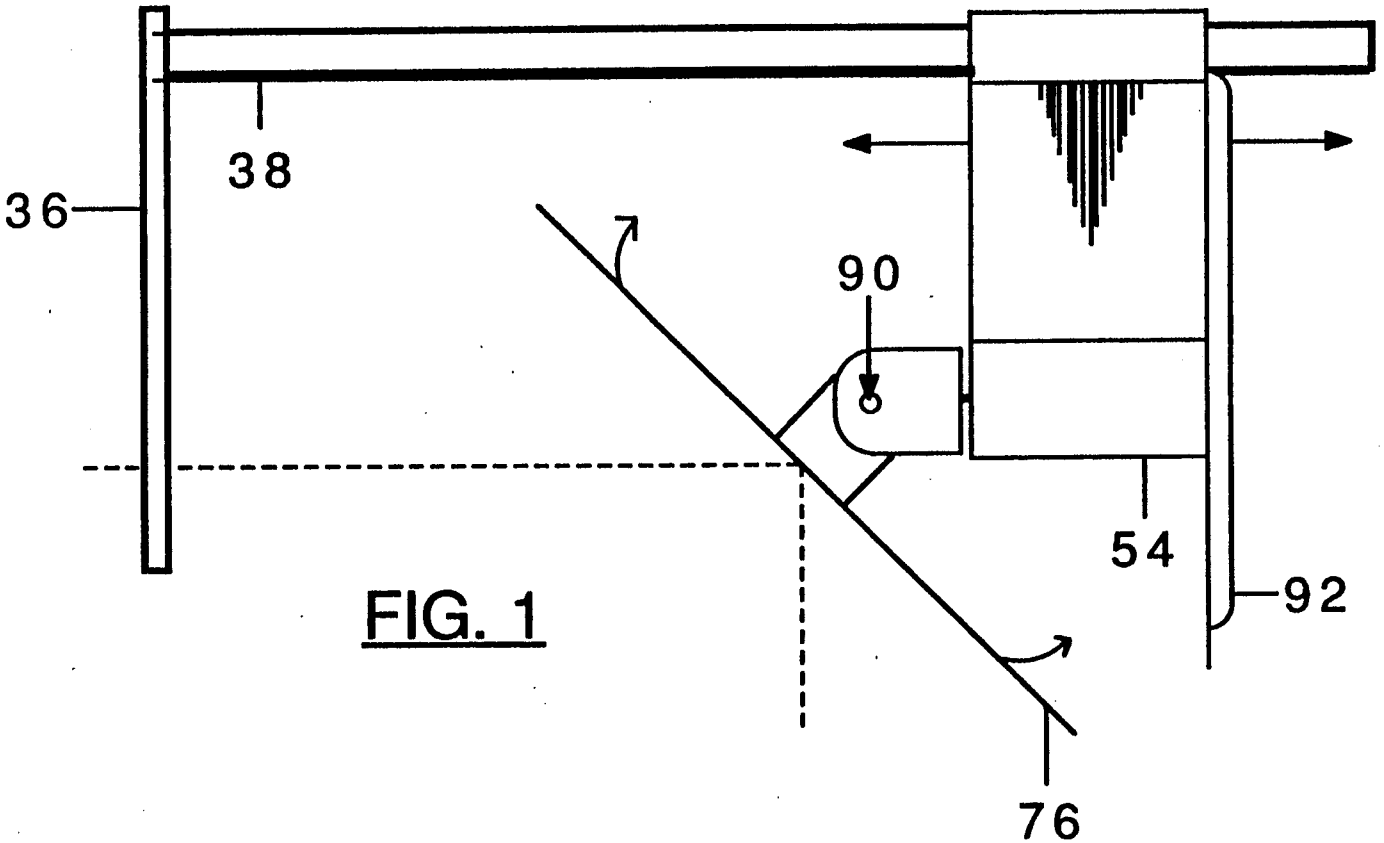
Figure 2A:
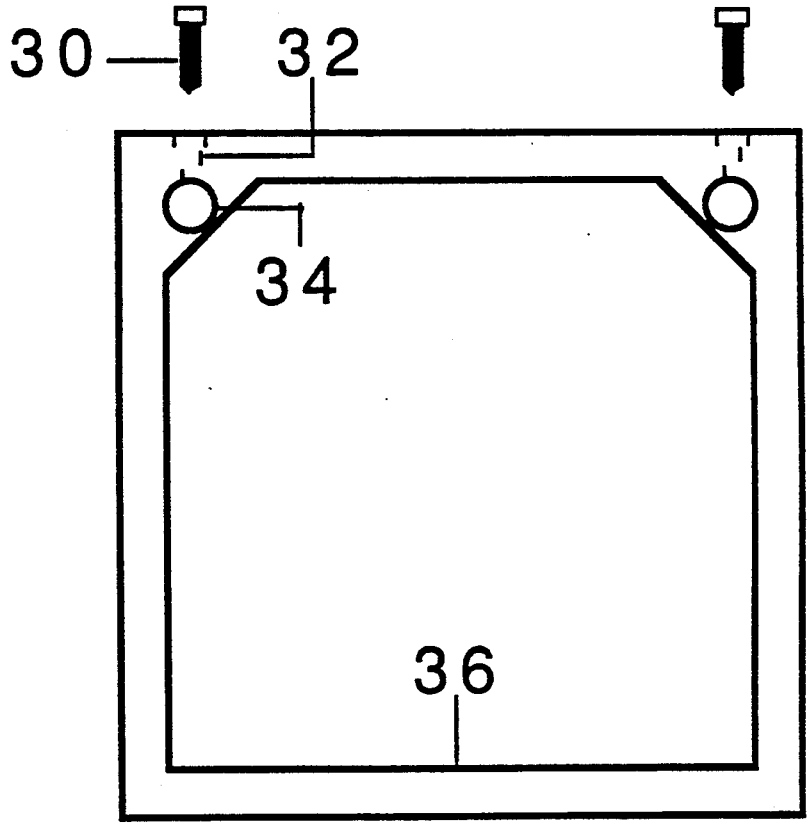
Figure 2B:
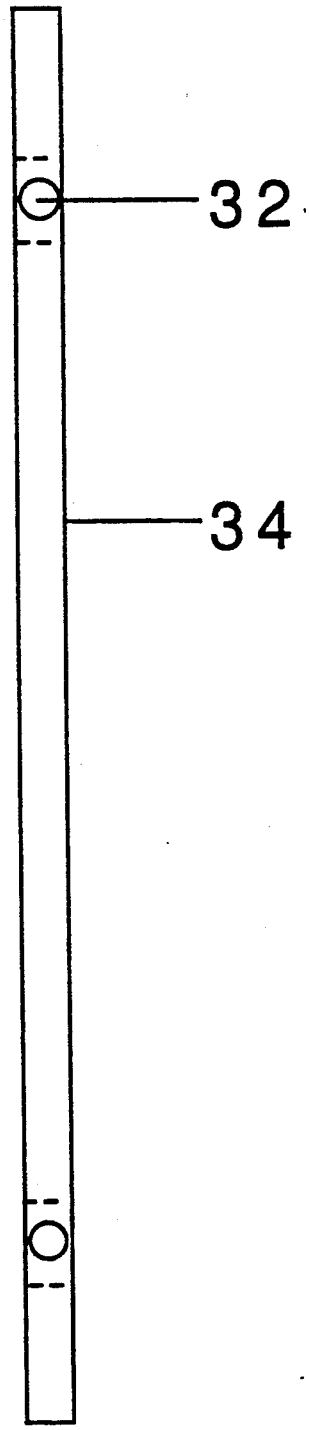
Figure 3A:
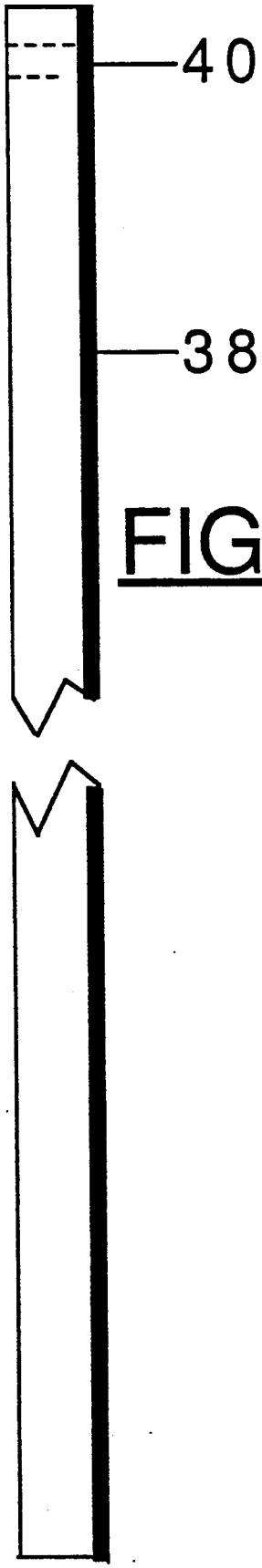
Figure 4:
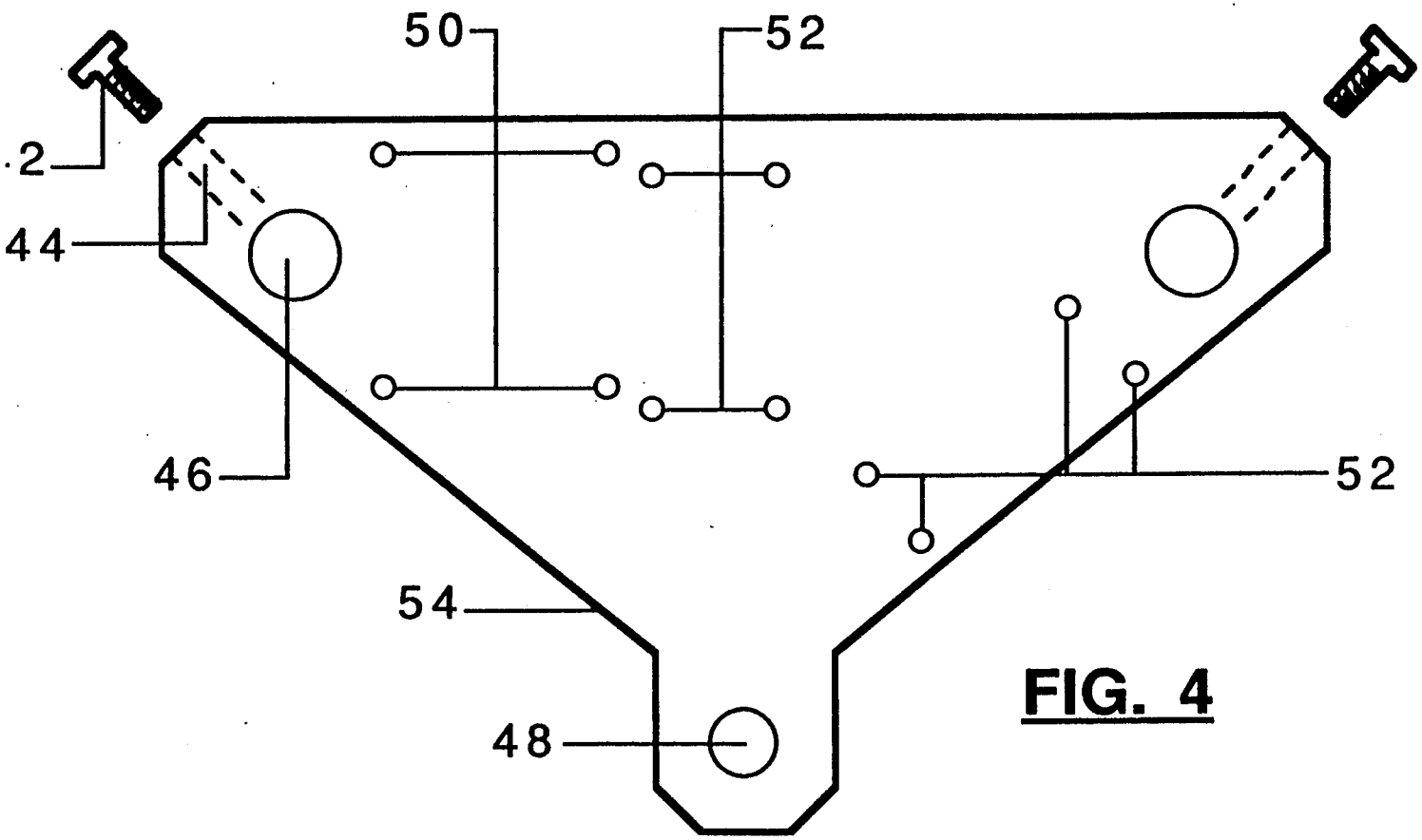
FIG. 4 shows the main plate with mounting holes.
Figure 5:
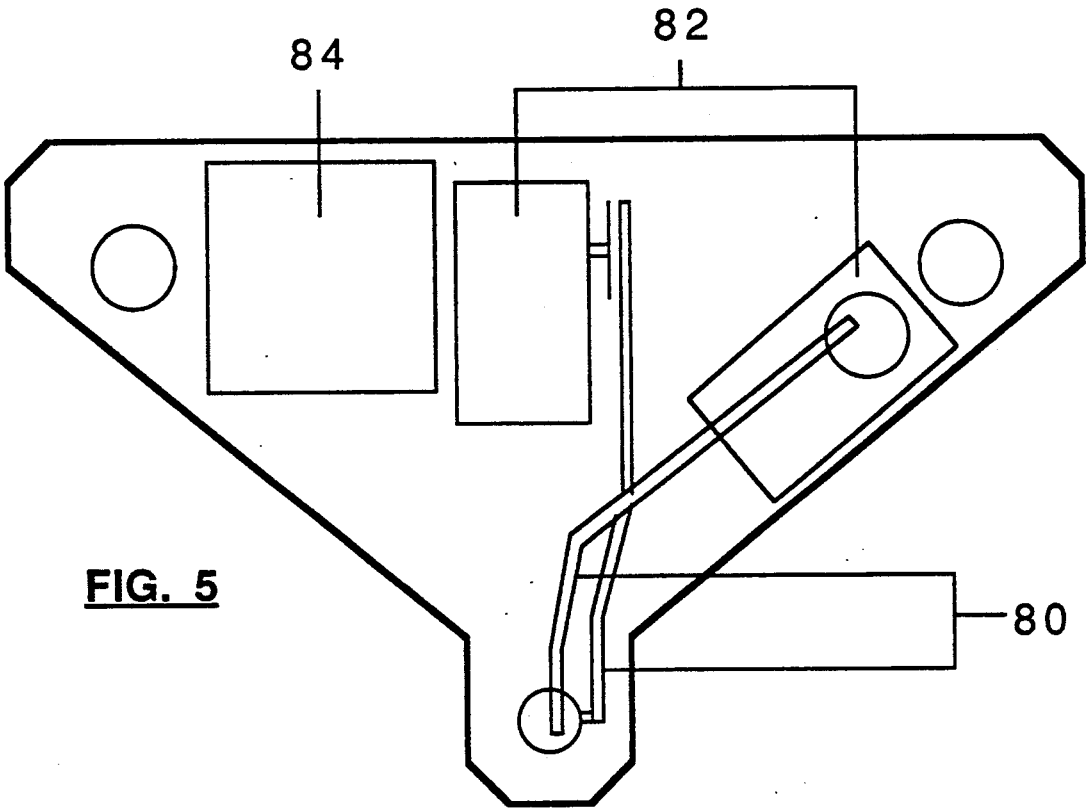
FIG. 5 shows the main plate with servo and circuit board layout.

A typical embodiment of the invention is illustrated in FIG. 1. The invention is constructed preferably out of aluminum. However, the unit can be constructed out of any known metal, wood, or plastic that can be formed into the required shapes.

At one end of the invention is a frame plate 36 that is inserted into the color media holder or attached to the end of any known lighting fixture. Two corners have holes 34 for the insertation of rods 38 to support the main plate 54. Screws 30 and holes 32 for screws hold the rods at right angles to the frame plate. Holes 40 allow screws 30 to secure rods 38 to frameplate 36. One or more rods allows the main plate 54 to be slid and positioned along said rods. This allows the main plate 54 to be best positioned to any lighting fixture's light beam. Screws 42 inserted into holes 44 prevent the main plate from movement due to gravitational or other forces.

The main plate holes 46 facilitate the sliding of the main plate along the rods. The main plate has a means for attachment of a universal joint 90 which manipulates the reflecting device 76. The main plate also has holes 52 and 50 for servo motors and a circuit board respectively, and control linkage 80 to manipulate a universal joint 90. A hole 48 in said main plate 54 allows attachment of said universal joint 90.

The universal joint 90 consists of bodies 60 and 66 which interconnect to allow one body 60 to pivot around the pan or X axis, and one body 66 to pivot around the tilt or Y axis. An axle 58 on body 60 allows pivoting around the X axis and provides a means for attaching said universal joint to said main plate. A shaft 65 in body 66 allows pivoting around the Y axis. A hole 56 through shaft 58 allows said linkage 80 to control body 66 of said universal joint 90. Hole 62 allows for the attachment of a tension spring to return body 66 to a resting position. Body 66 also has hole 64 for the insertation of a pin or screw to secure body 66 to body 60.

The reflecting means 76 is polished metal or a mirror. The mounting of the reflector to the universal joint is done in the exact center of the reflector means to allow full use of the reflecting means surface.

A shroud 92 is incorporated to retain any extranious light that might not be reflected by the reflecting means 76.

Servo motors 82 are controled by a pulse width modulation from circuit board 84 initiate the control linkage 80 for X and Y movement of the universal pivot 90.

From the description above, a number of advantages of our universal light beam manipulating invention becomes evident:

(a) This invention can be adapted to any lighting fixture.

(b) This invention can be controlled by any lighting console or computer system, personal, business, or one specialized for the lighting industry, with an accesable control signal.

(c) The servo drive system offers quicker, smoother, and quieter response than other current drive system. Also, the upkeep of the servos is less than current drive systems.

(d) The technology is immedeatly available to control the invention with a wired or wireless signal.

(e) The operation of the invention is more simplistic than current devices due to the assumed familiarity of the control system in posession of the consumer used to drive the invention by the operator.

(f) The installation of the invention is simply a matter of attaching the invention to the end of a lighting fixture.

(g) The cost of the unit is greatly reduced due to the lack of a light source incorporated in the unit.

OPERATION—FIGS. 1 AND 5

The invention is attached to the end of a lighting fixture by way of inserting the frame plate 36 into the color media holder or by securing the invention to the end of the lighting fixture with a universal adapter plate.

The rods 38 attached to frame plate 36 with screws 30 supports the main plate 54 in any position along the length of the rods 38.

The main plate 54 is positioned along the rods 38 to best capture the focal point of the employed lighting fixture's light beam. The main plate 54 is held in position with screws 42. The servo motors 82 mounted on main plate 54 use linkage assembly 80 to facilitate movement of the universal pivot 90.

The circuit board 84 translates the control signal to a pulse width modulation that servo motors 82 can understand and respond accordingly. Response of the universal joint is directly related to the movement of the servo motors 82 and linkage assembly 80.

SUMMARY, RAMIFICATIONS, AND SCOPE

Accordingly, the reader will see the our universal light beam manipulator can be readily used to control the direction of light beams by those in the industry with only minimal training of our invention's operation. Also, our invention has the ability to adapt to any known lighting fixture with minimal modifications to our invention such as replacing the frame plate with another of proper size for a particular lighting fixture and by repositioning the main plate to the focal point of the lighting fixture to best capture the beam emited. Furthermore, our universal light beam manipulator has additional advantages in that:

it is simplistic to operate due to the lack of a specialized control console;

the minimal parts allow ease of user servicing;

the servo motors are faster, and smoother than current motor systems;

the absence of a fan makes our invention quieter than other units on the market;

technology is available to have our invention be controlled from a wired or wireless signal.

Although the above contains many specificities, these should not be construed as limiting the scope of the invention but as merely providing illustration of some of the presently preferred embodiments of this invention. Thus the scope of this invention should be determined by the appended claims and their legal equivalents, rather than by the examples given above.

What is claimed is:

1. A light beam manipulator for converting any known lighting fixture to a remotely controllable lighting fixture, comprising:

a frame plate of sufficient size and shape to attach to the end of said lighting fixture, a plurality of axles with attachment means to said frame plate, a main plate, openings in said main plate to allow said axles to suport said main plate along the length of said axles, said main plate has an opening for attachment of a universal joint, a first body of said universal joint mounted to said main plate for rotation about a pan axis, a second body of said universal joint mounted in said first body for rotation about a tilt axis, a reflecting means mounted to said universal joint, a first motor system mounted to said main plate to induce movement of said first body of said universal joint in said pan axis, a second motor system mounted to said main plate to induce movement of said second body of said universal joint in said tilt axis, a linkage assembly to transmit said first motor inertia to said first body of said universal joint, a linkage assembly to transmit said second motor inertia to said second body of said universal joint, a means for recieving, translating, and utilizing a control signal for controlling said motors and linkage assemblies.

* * * * *